US007472934B2

(12) United States Patent
Burke et al.

(10) Patent No.: US 7,472,934 B2
(45) Date of Patent: Jan. 6, 2009

(54) SOLENOID OPERATED LATCHING STRIKE

(75) Inventors: Christopher John Burke, Ramsgate (AU); Richard Bruce Harward, Robina (AU)

(73) Assignee: Securicom (NSW) Pty. Ltd., New South Wales (AU)

( * ) Notice: Subject to any disclaimer, the term of this patent is extended or adjusted under 35 U.S.C. 154(b) by 68 days.

(21) Appl. No.: 10/535,051

(22) PCT Filed: Nov. 13, 2003

(86) PCT No.: PCT/AU03/01518

§ 371 (c)(1),
(2), (4) Date: Mar. 16, 2006

(87) PCT Pub. No.: WO2004/044357

PCT Pub. Date: May 27, 2004

(65) Prior Publication Data

US 2006/0202490 A1 Sep. 14, 2006

(30) Foreign Application Priority Data

Nov. 13, 2002 (AU) ..... 2002952629

(51) Int. Cl.
*E05B 15/02* (2006.01)

(52) U.S. Cl. ..... 292/341.16; 292/340

(58) Field of Classification Search ..... 292/201, 292/340, 341.16

See application file for complete search history.

(56) References Cited

U.S. PATENT DOCUMENTS

| | | | | | |
|---|---|---|---|---|---|
| 3,861,727 | A * | 1/1975 | Froerup et al. | ..... | 292/341.16 |
| 4,026,589 | A * | 5/1977 | Hanchett, Jr. | ..... | 292/341.16 |
| 4,056,277 | A * | 11/1977 | Gamus et al. | ..... | 292/341.16 |
| 5,219,196 | A * | 6/1993 | Luker | ..... | 292/341.16 |
| 5,690,373 | A * | 11/1997 | Luker | ..... | 292/201 |
| 5,988,711 | A * | 11/1999 | Toma | ..... | 292/341.16 |
| 6,568,726 | B1 * | 5/2003 | Caspi et al. | ..... | 292/341.16 |

FOREIGN PATENT DOCUMENTS

AU 200066674 10/2000

* cited by examiner

*Primary Examiner*—Gary Estremsky
(74) *Attorney, Agent, or Firm*—Brinks Hofer Gilson & Lione

(57) ABSTRACT

A latching strike assembly for a door lock has a body (1, 201, 301) adapted to be fitted to a doorjamb. A latching strike (4, 204, 304) is mounted to the body (1, 201, 301) and defines a boundary of the latch bolt recess (3, 203, 303) of the body (1, 201, 301). The latching strike (1, 204, 304) is pivotable between open and closed positions for releasing and retaining a latch bolt (100) respectively. A bi-stable detent (7, 207, 307) is displaceable between a sable locking position at which the detent (7, 207, 307) engages the latching strike (4, 204, 304) to lock the latching strike (4, 204, 304) in the closed position and a stable unlocking position at which the detent (7, 207, 307) is disengaged from the latching strike (4, 204, 304), thereby enabling the latching strike (4, 204, 304) to be deflected to the open position by the latch bolt (100). The detent (7, 207, 307) may be displaced between the locking and unlocking positions either by a single solenoid (314) or by two separate solenoids (14, 15, 214, 215).

8 Claims, 14 Drawing Sheets

SOLENOID OPERATED LATCHING STRIKE

This application is the National Stage of International Application No. PCT/AU2003/001518, filed Nov. 13, 2003, which claims the benefit of priority to Australian Patent Application 2002952629, filed on Nov. 13, 2002. All of the foregoing applications are hereby incorporated herein in their entirety in this application.

FIELD OF THE INVENTION

The present invention relates to locks, and more particularly relates to solenoid operated latching strikes for remotely operated door locks.

BACKGROUND OF THE INVENTION

Remotely operated door locks are often used to provide security controlled access to offices, home units, banks and other buildings requiring access control.

Such door locks typically consist of a retractable spring biased latch bolt fitted to the edge of the door and a latching strike assembly fitted to the doorjamb. A latching strike positioned at the edge of a recess defined in the body of the latch strike assembly is pivotally displaceable between a closed position retaining the latch bolt within the recess and an open position releasing the latch bolt from the recess. The latch bolt retracts and rides over the edge of the latching strike and into the recess upon closing of the door. A locking means, typically in the form of a pin or set of pins or system of levers, is operated by way of a solenoid to lock the latching strike in the closed position to thereby lock the latch bolt within the recess and thereby retain the door in a locked state.

The presently available door locks as described above utilise a single solenoid to move the locking means between the locked and unlocked positions. The door locks are provided in one of two configurations. In the first 'fail safe' configured type of lock the locking means is maintained in the locking position when the solenoid is energised and in the unlocking position when the solenoid is not energised, providing a fail safe operation of the door lock, ensuring the door is unlocked when there is a power failure de-energising the solenoid. In the second 'fail secure' configured type of lock the locking means is maintained in the unlocking position when the solenoid is energised and in the locking position when the solenoid is not energised, providing a fail secure operation of the door lock, ensuring the door is locked when there is a power failure. In both of these configurations only one or the other of the locking and unlocking positions is a stable state.

These door locks require a constant power supply and energising of the solenoid to keep the locking means in either of the locked or unlocked positions (depending upon whether a fail safe or fail secure configuration). As a result of this power requirement, which is usually backed by a back up battery power supply to ensure continuous operation, these systems generally use a centralised electronic control system requiring significant wiring and infrastructure. Accordingly, these systems are not particularly suitable for small to medium buildings such as residential, small businesses, old style dwellings and multiple buildings that are difficult or expensive to cable back to a central system.

OBJECT OF THE INVENTION

It is an object of the present invention to overcome or substantially ameliorate the above disadvantages, or at least to provide a useful alternative.

SUMMARY OF THE INVENTION

There is disclosed herein a latching strike assembly for a door lock comprising:

a body adapted to be fitted to a doorjamb, said body defining a recess for receipt of a latch bolt;

a latching strike mounted to said body and defining a boundary of said recess, said latching strike being pivotable between a closed position for retaining said latch bolt within said recess and an open position for releasing said latch bolt from said recess;

a bi-stable detent displaceable between a stable locking position at which said detent engages said latching strike to lock said latching strike in said closed position and a stable unlocking position at which said detent is disengaged from said latching strike, thereby enabling said latching strike to be deflected into said open position by said latch bolt;

a first solenoid adapted to displace said detent from said locking position to said unlocking position; and a second solenoid adapted to displace said detent from said unlocking position to said locking position.

Typically, said locking and unlocking positions are made stable by way of a biasing spring.

Preferably, said biasing spring is an over centre spring.

Typically, said detent, when in said locking position, engages an arm of said latching strike to lock said latching strike in said closed position.

In one form, said detent is pivotally displaceable between said locking and unlocking positions.

In another form, said detent is linearly displaceable between said locking and unlocking positions. Said detent may comprise an elongate pin.

There is further disclosed herein a latching strike assembly for a door lock comprising:

a body adapted to be fitted to a doorjamb, said body defining a recess for receipt of a latch bolt;

a latching strike mounted to said body and defining a boundary of said recess, said latching strike being pivotable between a closed position for retaining said latch bolt within said recess and an open position for releasing said latch bolt from said recess;

a bistable detent displaceable between a stable locking position at which said detent engages said latching strike to lock said latching strike in said closed position and a stable unlocking position at which said detent is disengaged from said latching strike, thereby enabling said latching strike to be deflected into said open position by said latch bolt; and a solenoid adapted to displace said detent from said locking position to said unlocking position when activated by an unlocking control signal and from said unlocking position to said locking position when activated by a locking control signal.

Typically, said detent, when in said locking position, engages an arm of said latching strike to lock said latching strike in said closed position.

In one form, said detent is linearly displaceable between said locking and unlocking positions. Said detent may comprise an elongate pin.

Typically, said solenoid is a latching-type solenoid having a plunger displaceable between retracted and extended positions, displacement of said plunger to said extended position displacing said detent to one of said locking and unlocking positions, said solenoid having a latching mechanism for latching said plunger in said extended position, wherein a return spring is operatively associated with said detent and/or said solenoid plunger to bias said plunger to said retracted position, and said detent to the other of said locked and unlocked positions, upon unlatching of said latching mechanism.

In one form, said return spring is mounted on said detent.

In one form, displacement of said plunger to said extended position displaces said detent to said locking position.

BRIEF DESCRIPTION OF THE DRAWINGS

Preferred forms of the present invention will now be described by way of example with reference to the accompanying drawings, wherein.

DETAILED DESCRIPTION OF THE PREFERRED EMBODIMENTS

Figure 1:
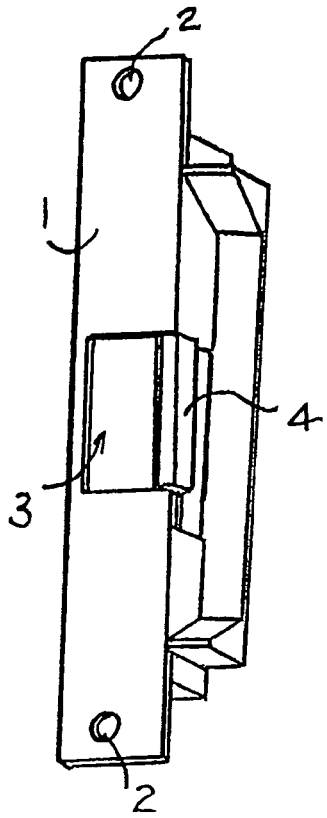
FIG. 1 is a perspective view of a first latching strike assembly for a door lock.
Figure 2:
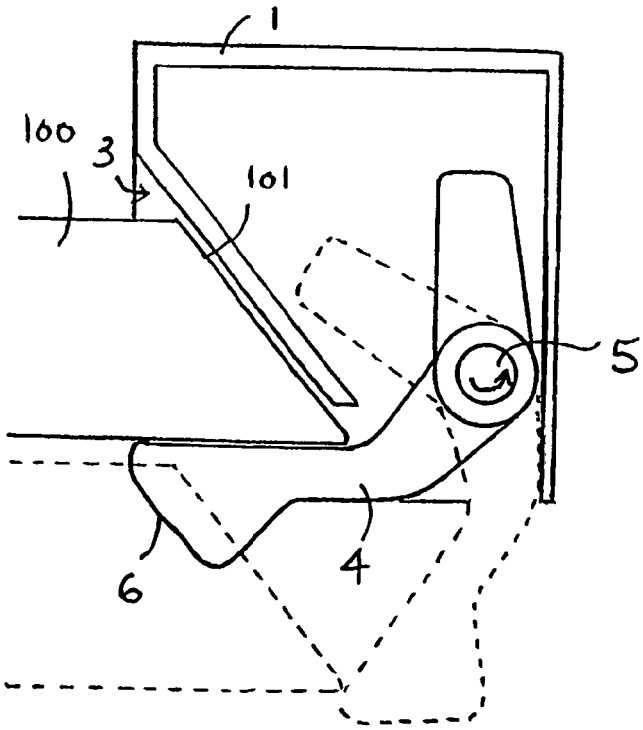
FIG. 2 is a schematic plan view depicting the operation of the latching strike of the latching strike assembly of FIG. 1.

Referring to FIG. 1 of the accompanying drawings, a first latching strike assembly for a door lock has a body 1 adapted to be fitted to a recess within a door jamb by way of fasteners passing through holes 2 formed in the front face of the body 1. The body defines a recess 3 for receipt of a latch bolt 100 as depicted in FIG. 2. The latch bolt 100 is fitted to the edge face of the door mounted in the doorway defined by the door jamb and is spring loaded to enable it to extend and retract in the usual manner.

A latching strike 4 is mounted to the body 1 and defines a boundary of the recess 3. The latching strike 4 is pivotable about a pivot pin 5 mounted within the body 1 between a closed position, as depicted in solid lines in FIG. 2, and an open position, as depicted in broken lines in FIG. 2. In the closed position, the latching strike 4 retains the latch bolt 100 within the recess 3, whilst in the open position the latching strike 4 releases the latch bolt 100 from the recess 3. The latching strike 4 is spring biased to the closed position in the usual manner by way of a torsion spring (not depicted) encircling the pivot pin 5. During the action of closing the door, the chamfered end face 101 of the latch bolt 100 engages the angled leading face 6 of the latching strike 4 in the closed position. This engagement causes the latch bolt 100 to retract and ride up over the latching strike 4 and into the recess 3 to thereby hold the door in the closed position.

Figure 3:
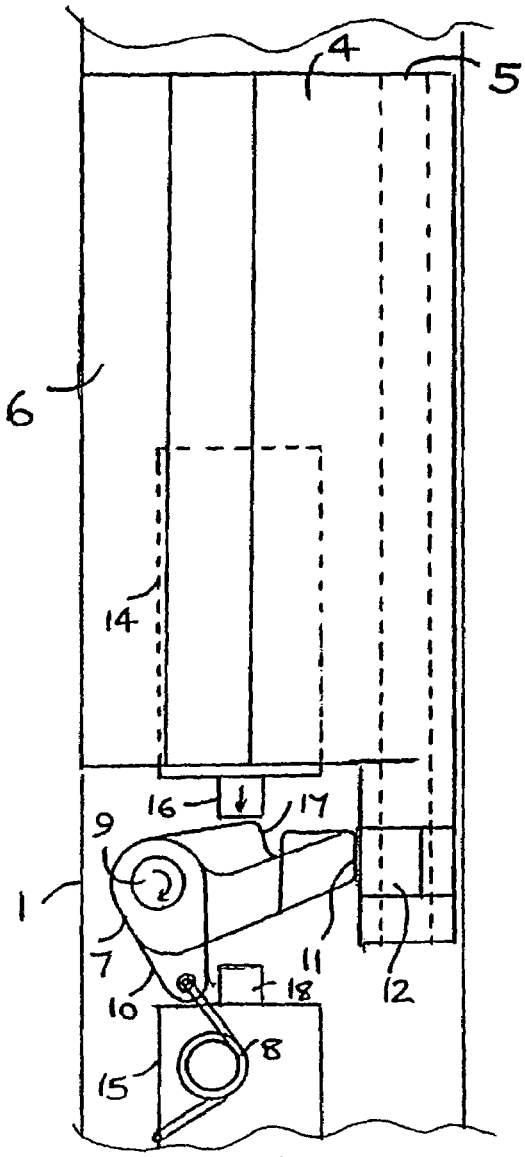
FIG. 3 is a schematic side elevation view of the latching strike assembly of FIG. 1 in a locked state.
Figure 4:
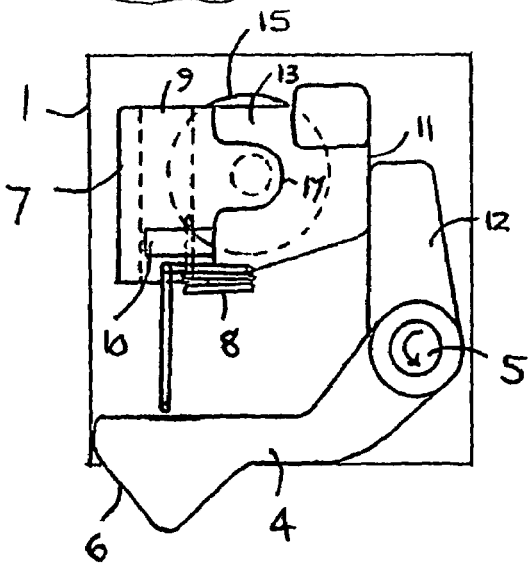
FIG. 4 is a schematic plan view of the latching strike assembly of FIG. 1 in a locked state.
Figure 5:
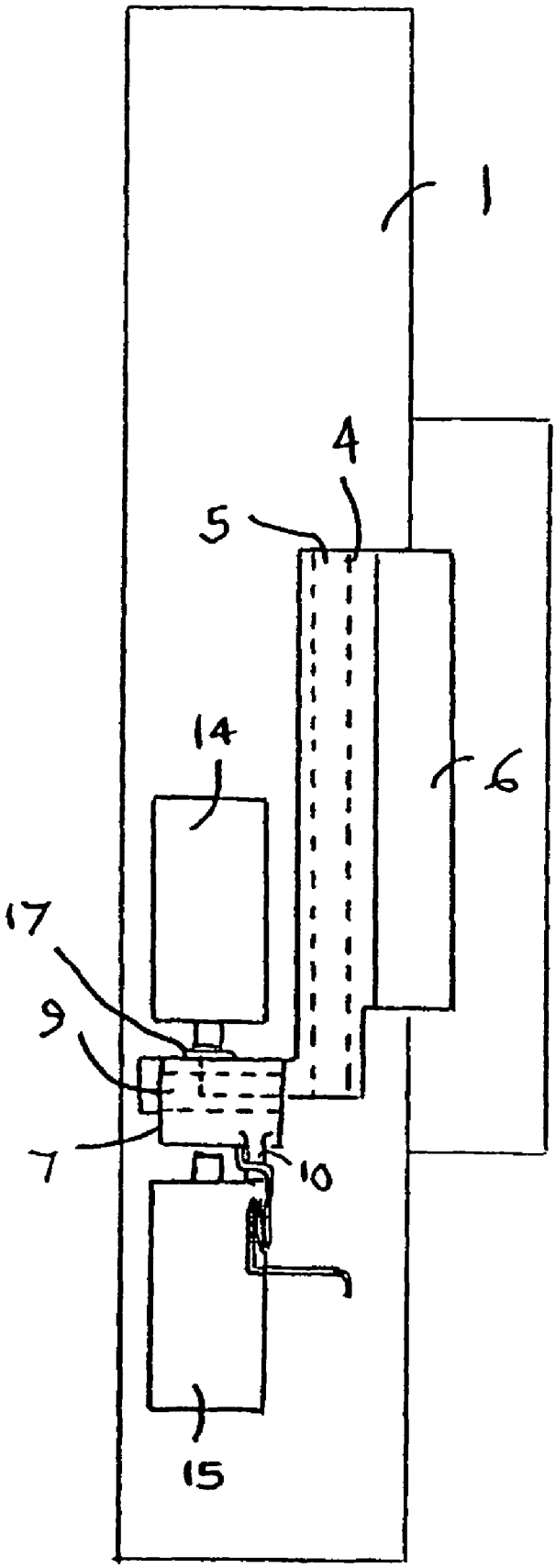
FIG. 5 is a schematic front elevation view of the latching strike assembly of FIG. 1 in a locked state.

The latching strike 4 is locked in the closed position, depicted in FIGS. 3 through 5, by way of a bi-stable detent in the form of a toggle 7. The toggle 7 is pivotally displaceable between a stable locking position, depicted in FIGS. 3 through 5, at which the toggle 7 engages the latching strike 4 to lock the latching strike 4 in the closed position, and a stable unlocking position, depicted in FIGS. 6 and 7, at which the toggle 7 is disengaged from the latching strike 4, thereby enabling the latching strike 4 to be deflected into the open position by the latch bolt 100.

Figure 6:
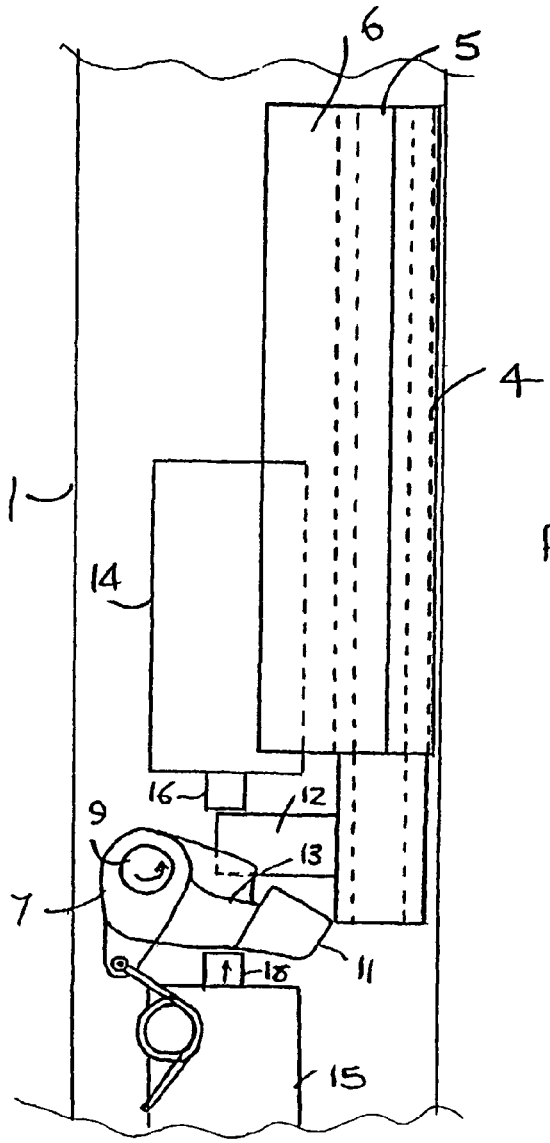
FIG. 6 is a schematic side elevation view of the latching strike assembly of FIG. 1 in an unlocked and open state.

The toggle 7 is bistable in that the toggle 7 is stably held in either of the locking and unlocking positions. This stability is provided by way of a biasing spring in the form of an over centre spring 8. When the toggle 7 is in the locking position as depicted in FIG. 3 the over centre spring 8 creates an anti-clockwise moment (as viewed in FIG. 3) tending to retain the toggle 7 in the locking position. When the toggle 7 is in the unlocking position as depicted in FIG. 6, the position of the over centre spring 8 in relation to the toggle pivot pin 9 results in a clockwise moment (as viewed in FIG. 6) being created which retains the toggle 7 in the unlocking position. The over centre spring 8 is fixed at one end to the assembly body 1 and at the opposing end to a tab 10 formed on the toggle 7.

When the toggle 7 is in the locking position, depicted in FIGS. 3 to 5, an end engagement face 11 of the toggle 7 engages an arm 12 of the latching strike 4. As can best be seen from FIG. 4, engagement between the toggle engagement face 11 and the latching strike arm 12 locks the latching strike 4 in the closed position, preventing it from rotating anti-clockwise (as viewed in FIG. 4) towards the open position.

Figure 7:
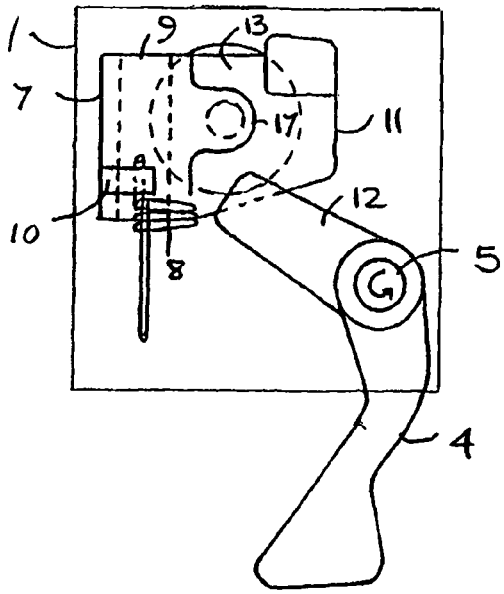
FIG. 7 is a schematic plan view of the latching strike assembly of FIG. 1 in an unlocked and open state.

When the toggle 7 is pivoted about the pivot pin 9 to the unlocking position depicted in FIGS. 6 and 7, the toggle engagement face 11 disengages the latching strike arm 12, enabling the latching strike 12 to pivot past the upper face 13 of the toggle as the latching strike 4 is moved to the open position (by engagement of the latch bolt 100 as the door is opened).

The toggle 7 is displaced between the locking and unlocking positions by way of first and second solenoids 14, 15. Activation of the first solenoid 14 drives the plunger 16 of the first solenoid 14 against a raised pad 17 formed on the toggle upper face 13, thereby pivoting the toggle 7 to the unlocking position. Conversely, activation of the second solenoid 15 drives the plunger 18 of the second solenoid against the lower face 19 of the toggle 7 to thereby move the toggle 7 to the locking position.

Movement of the toggle 7 between the locking and unlocking positions only requires a single pulse activation of either of the solenoids. Once the toggle 7 has been displaced to the alternate stable position, the activated solenoid can be immediately deactivated as opposed to in the prior art systems described above where the solenoid must remain activated to keep the detent in one of the two positions (with one position being stable and the other being unstable and requiring continual force to be applied by the solenoid plunger).

Without the need for continual activation of either of the solenoids, the manner in which the latching strike assembly described may be powered and controlled is quite flexible. Due to the minimal power required, the latching strike assembly may be powered by batteries without the need for extensive wiring back to a central power supply and controller. The latching strike assembly may be controlled by any of various simple codified security control systems. For example, the assembly may be operated by standard RF key fobs (as used extensively with motor vehicle keys) operated by the user. An initial signal conveyed by the key fob would trigger a single voltage pulse to the first solenoid to unlock the door, and a second signal from the key fob would activate the second solenoid 15 to lock the door. Alternatively, the second solenoid 15 might automatically be operated after a time delay or some other indication that the door is ready to be relocked. A series of latching strike assemblies on various doors within a particular installation might be programmed to accept the same key fob codified signal.

The latching strike assembly described is analogous to a standard key and lock in that the key fob or other activating device changes the state of the lock from locked to unlocked (and vice versa) and then the lock remains in the new state without the necessity for continuous power input.

FIGS. 8 to 14 of the accompanying drawings are equivalent drawings to those of FIGS. 1 to 7, but depict an alternative, second latching strike assembly for a door lock. The second latching strike assembly is similar to the first latching strike assembly of FIGS. 1 to 7, however in place of the pivotally displaceable toggle 7 of the first latching strike assembly, the bi-stable detent of the second latching strike assembly is linearly displaceable and in the form of an elongate detent pin 207.

Figure 8:
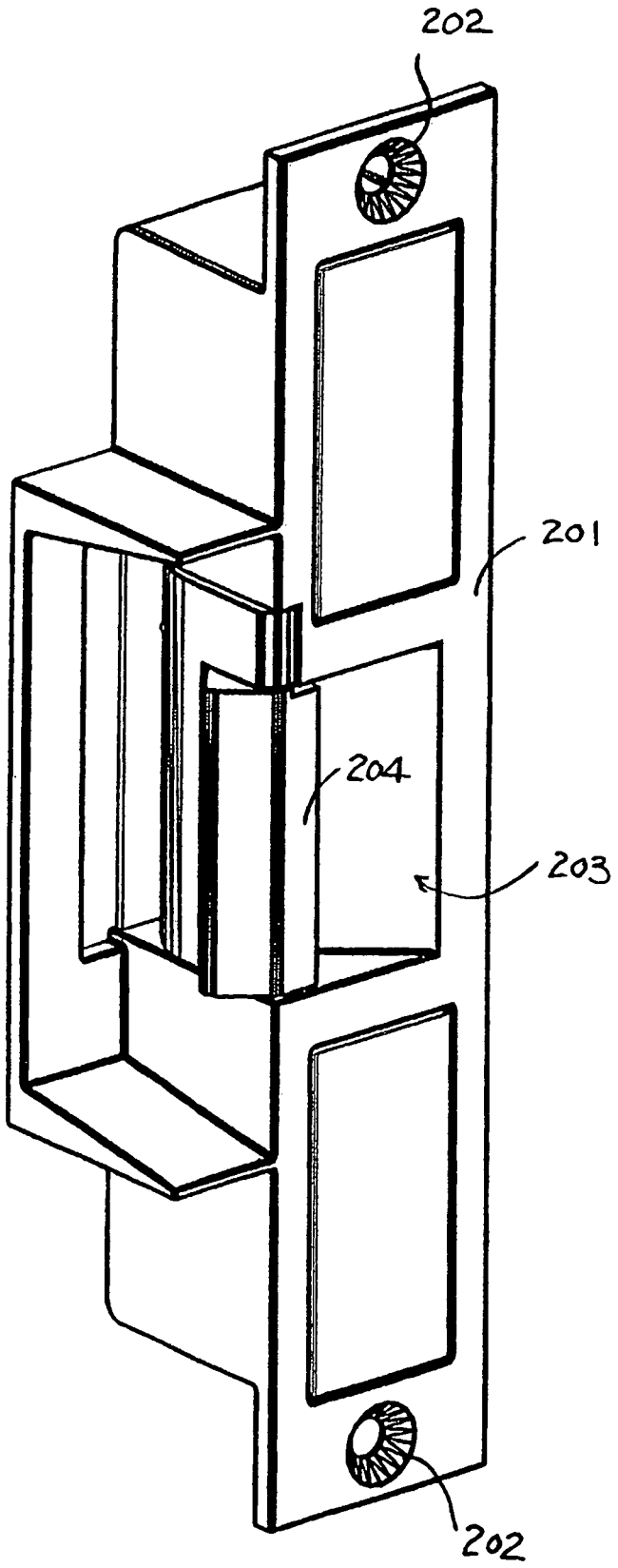
FIG. 8 is a perspective view of a second latching strike assembly for a door lock.
Figure 9:
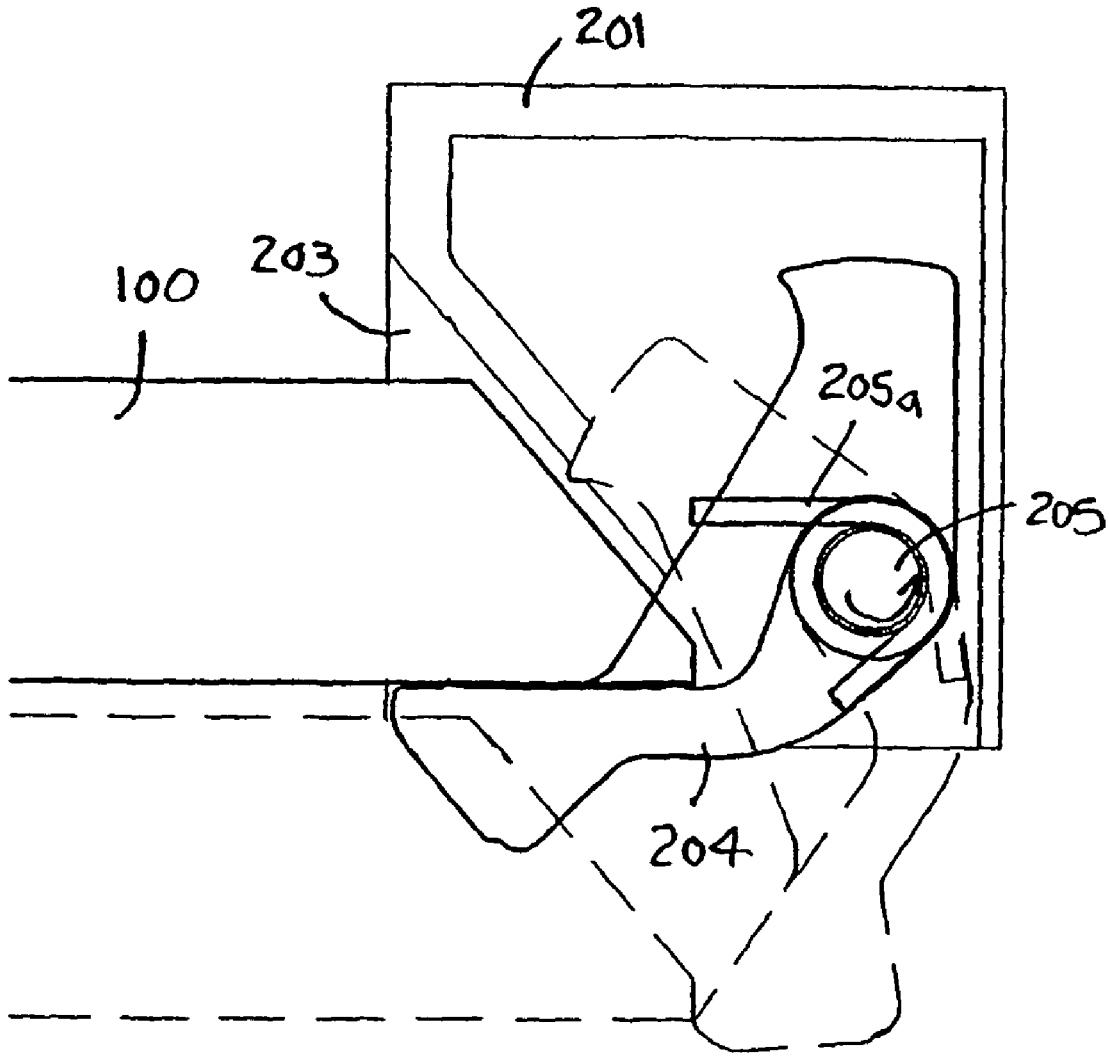
FIG. 9 is a schematic plan view depicting the operation of the latching strike of the latching strike assembly of FIG. 8.

Specifically, the second latching strike assembly has a body 201 adapted to be fitted to a recess within a doorjamb by way of fasteners passing through the holes 202 formed in the front face of the body 201 as depicted in FIG. 8. The body defines a recess 203 for receipt of a latch bolt 100 as depicted in FIG. 9.

A latching strike 204 is mounted to the body 201 and defines a boundary of the recess 203. The latching strike 204 is pivotable about a pivot pin 205 mounted within the body 201 between a closed position, as depicted in solid lines in FIG. 9, and an open position, as depicted in broken lines in FIG. 9. The latching strike 204 is spring biased to the closed position by way of a torsion spring 205*a* encircling the pivot pin 205.

Figure 10:
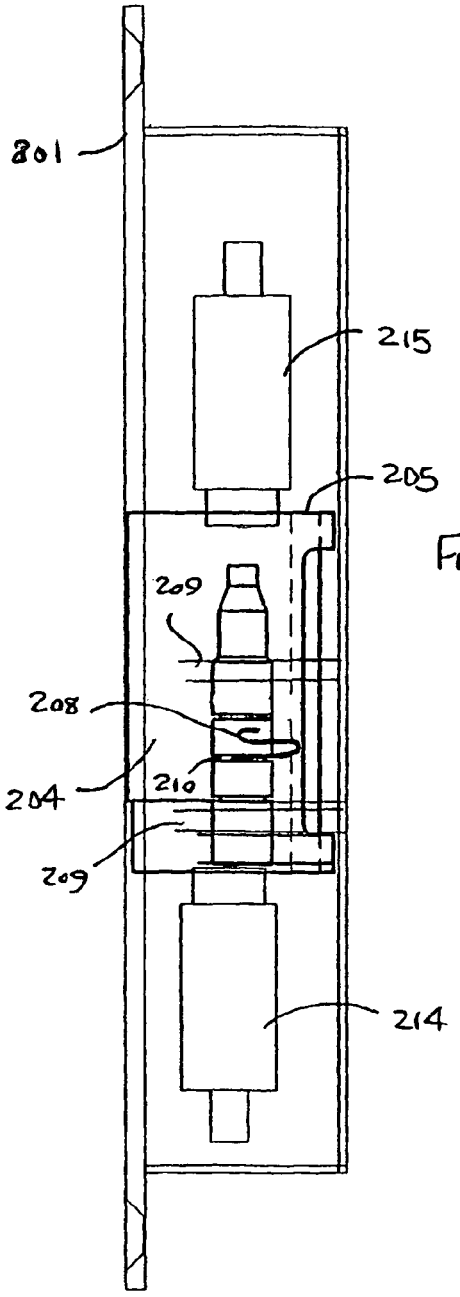
FIG. 10 is a schematic side elevation view of the latching strike assembly of FIG. 8 in a locked state.
Figure 11:
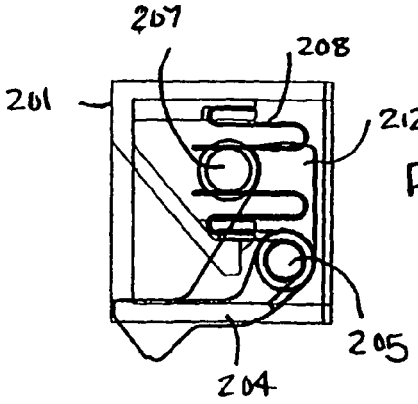
FIG. 11 is a schematic plan view of the latching strike assembly of FIG. 8 in a locked state.
Figure 12:
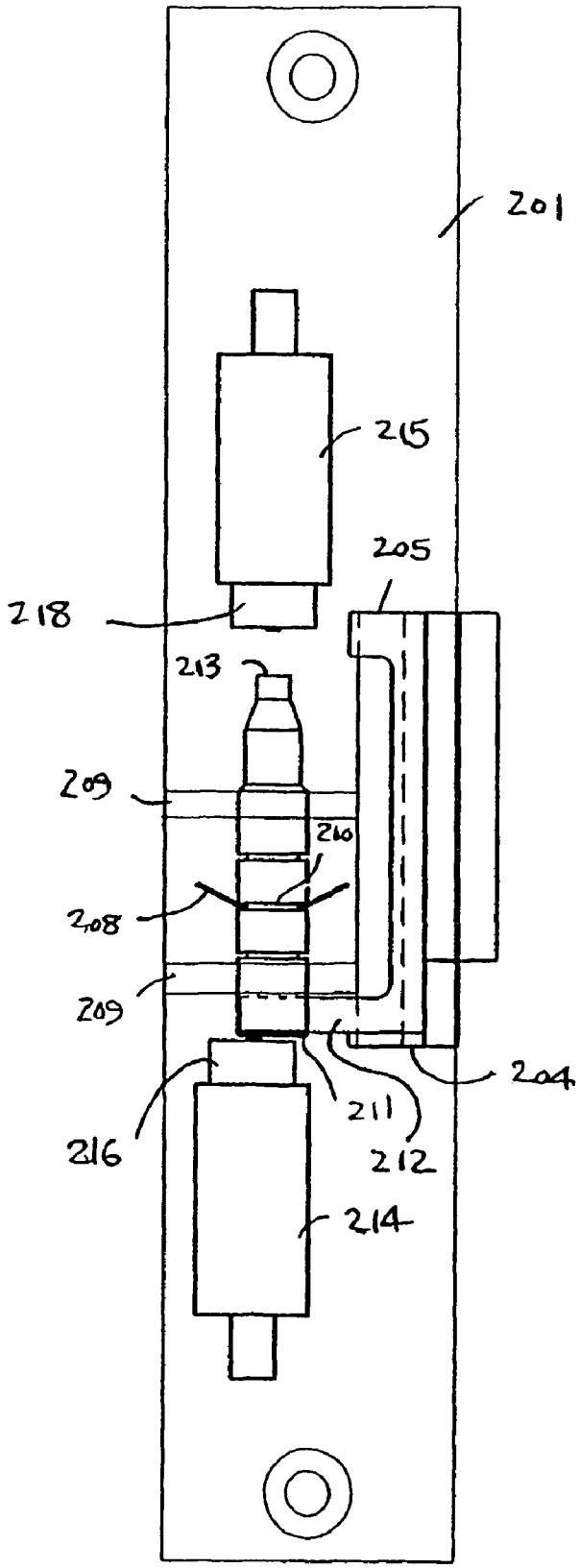
FIG. 12 is a schematic front elevation view of the latching strike assembly of FIG. 8 in a locked state.

The latching strike 204 is locked in the closed position, depicted in FIGS. 10 through 12, by way of a bi-stable detent in the form of the detent pin 207. The detent pin 207 is displaceable between a stable locking position, depicted in FIGS. 10 through 12, at which the detent pin 207 engages the latching strike 204 to lock the latching strike 204 in the closed position, and a stable unlocking position, depicted in FIGS. 13 and 14, at which the detent pin 207 is disengaged from the latching strike 204, thereby enabling the latching strike 204 to be deflected into the open position by the latching bolt 100.

The detent pin 207 is mounted within the assembly body 201 by two upstanding flanges 209 formed on the assembly body 201 and each having an aperture through which the detent pin 207 extends, thereby enabling longitudinal displacement of the detent pin 207.

Figure 13:
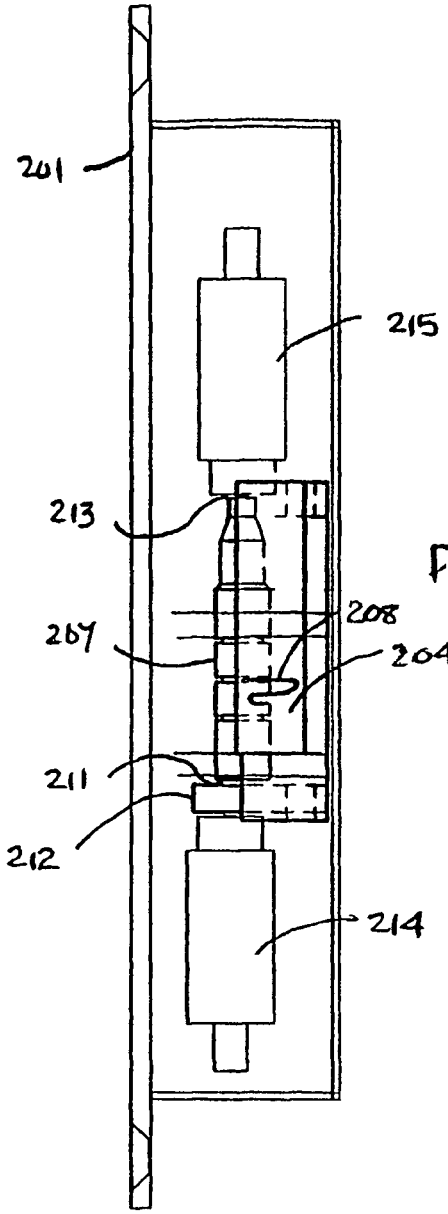
FIG. 13 is a schematic side elevation view of the latching strike assembly of FIG. 8 in an unlocked and open state.

The detent pin 207 is bi-stable in that the detent pin 207 is stably held in either of the locking or unlocking positions. This stability is provided by way of a biasing spring in the form of an over centre spring 208. When the toggle 207 is in the locking position as depicted in FIG. 10 the over centre spring 208 creates an axial load on the detent pin 207 tending to retain the detent pin 207 in the locking position. When the detent pin 207 is in the unlocking position as depicted in FIG. 13, the inclination of the over centre spring 208 in the opposing direction creates an axial load imparted on the detent 207 in the opposing axial direction, tending to retain the detent pin 207 in the unlocking position. The over centre spring 208 is formed of two halves, as is best depicted in FIG. 11, with opposing ends of each over centre spring half being mounted on the assembly body 201 and an annular recess 210 formed in the detent pin 207 respectively.

When the detent pin 207 is in the locking position, depicted in FIGS. 10 to 12, the peripheral surface of the detent pin 207 engages an arm 212 of the latching strike 204. As can be best seen from FIG. 11, engagement between the detent pin 207 and the latching strike arm 212 locks the latching strike 204 in the closed position, preventing it from rotating anti-clockwise (as viewed in FIG. 11) towards the open position.

Figure 14:
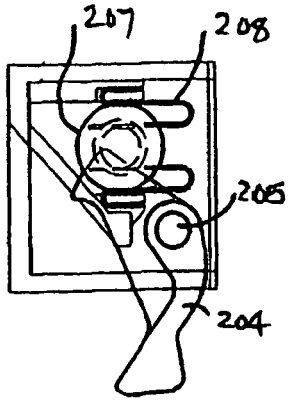
FIG. 14 is a schematic plan view of the latching strike assembly of FIG. 8 in an unlocked and open state.
Figure 15:
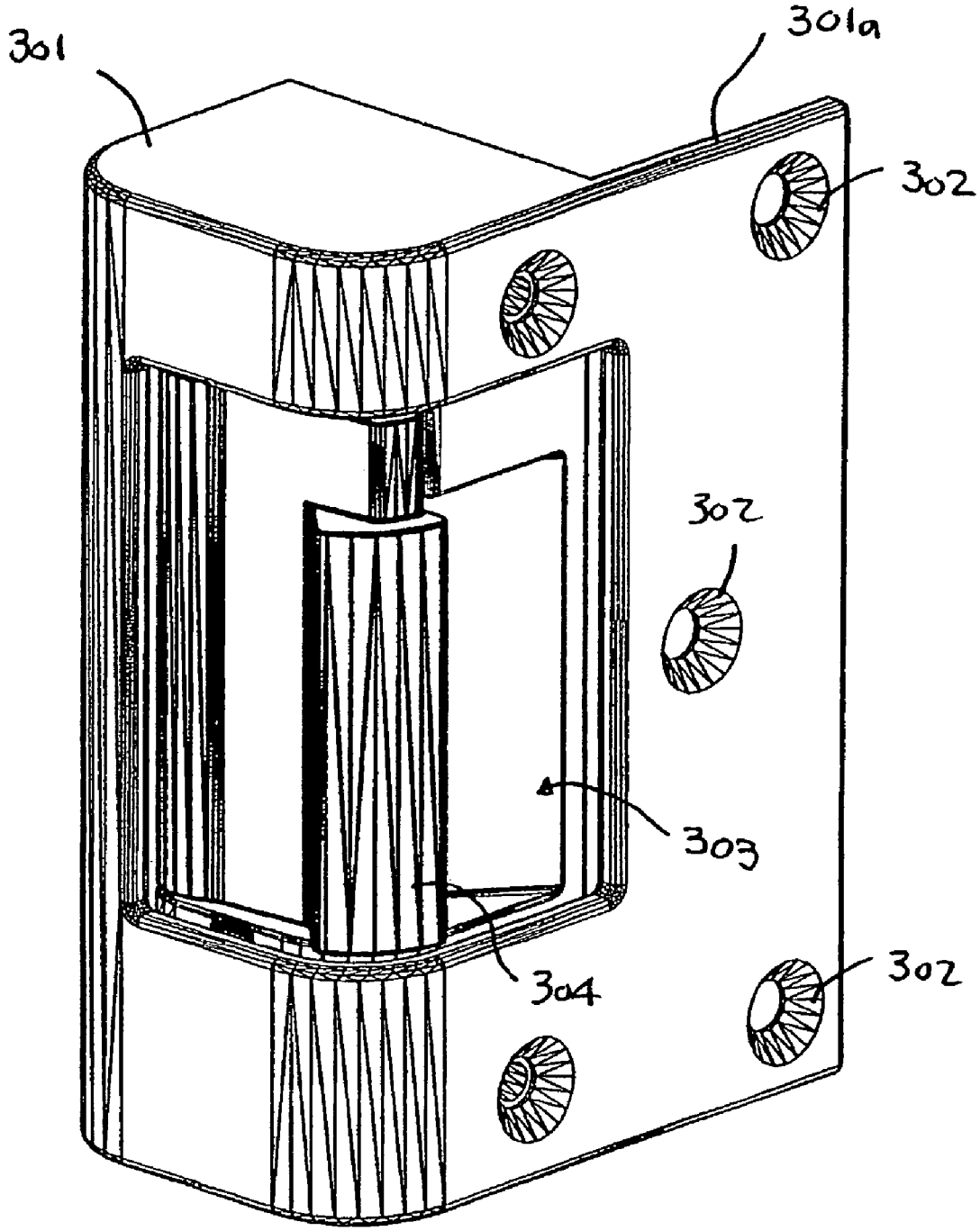
FIG. 15 is a perspective view of a third latching strike assembly for a door lock.

When the detent pin 207 is displaced upwardly to the unlocking position depicted in FIGS. 13 and 14, the detent pin 207 disengages the latching strike arm 212, enabling the latching strike arm 212 to pivot past the lower end face 211 of the detent pin 207 as the latching strike 204 is moved to the open position (by engagement of the latch bolt 100 as the door is opened).

The detent pin 207 is displaced between the locking and unlocking positions by way of first and second solenoids 214, 215. Activation of the first solenoid 214 extends the first solenoid plunger 216, engaging the lower end face 211 of the detent pin 207, thereby driving the detent pin 207 upwardly to the unlocking position as depicted in FIG. 13. The first solenoid plunger 216 subsequently retracts upon de-activation of the first solenoid 214 in the usual manner, leaving a gap between the detent pin lower end face 211 and the first solenoid plunger 216 in which the latching strike arm 212 may freely pivot. Conversely, activation of the second solenoid 215 extends the second solenoid plunger 218 to engage the upper end face 213 of the detent pin 207 downwardly to thereby drive the detent pin 207 to the locking position as depicted in FIG. 10.

As per the toggle 7 of the latching strike assembly of FIGS. 1 to 7, the detent pin 207 is moved between the locking and unlocking positions with only a single pulse activation of either of the solenoids. The second latching strike assembly of FIGS. 8 to 14 may accordingly be controlled in any of the same manners described for the first latching strike assembly of FIGS. 1 to 7.

FIGS. 15 to 21 of the accompanying drawings are again equivalent drawings to those of FIGS. 1 to 7, but depict a further alternative, third latching strike assembly for a door lock. The third latching strike assembly is similar to the second latching strike assembly of FIGS. 8 to 14, however only a single solenoid is utilised to drive the bi-stable detent.

Figure 16:
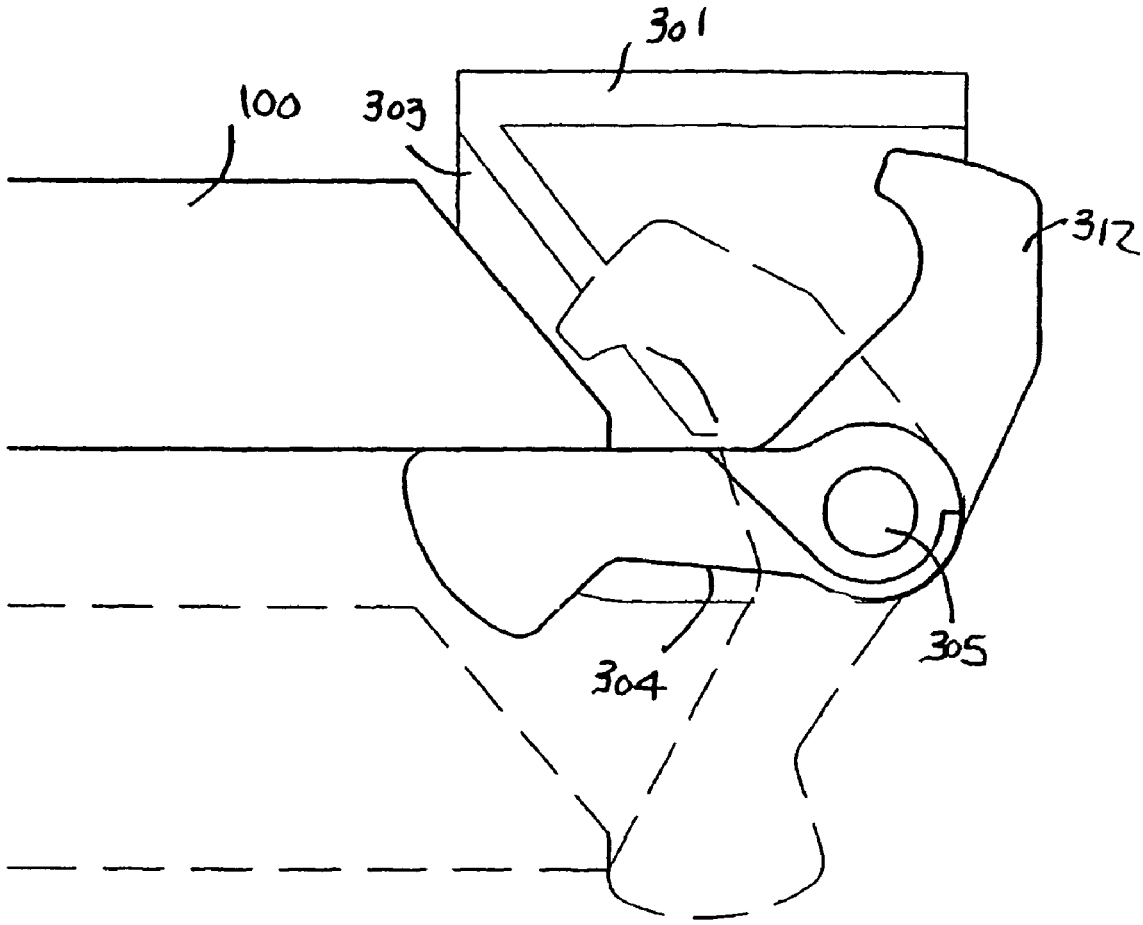
FIG. 16 is a schematic plan view depicting the operation of the latching strike of the latching strike assembly of FIG. 15.

Specifically, the third latching strike assembly has a body 301 adapted to be fitted to the face of a doorjamb by way of fasteners passing through holes 302 formed in an extended flange portion 301*a* of the front face of the body 301. Such a body 301, which can be fitted to the flush face of a door jamb rather than requiring a recess as per the bodies 1, 101 of the first and second latching strike assemblies, is particularly suitable for retro-fitting the latching strike assembly to door jambs without a recess, as is typical in residential applications. The body 301 defines a recess 303 for receipt of a latch bolt 100 as depicted in FIG. 16.

A latching strike 304 is mounted to the body 301 and defines a boundary of the recess 303. The latching strike 304 is pivotable about a pin 305 mounted within the body 301 between a closed position as depicted in solid lines in FIG. 16, and an open position, as depicted in broken lines in FIG. 16.

Figure 17:
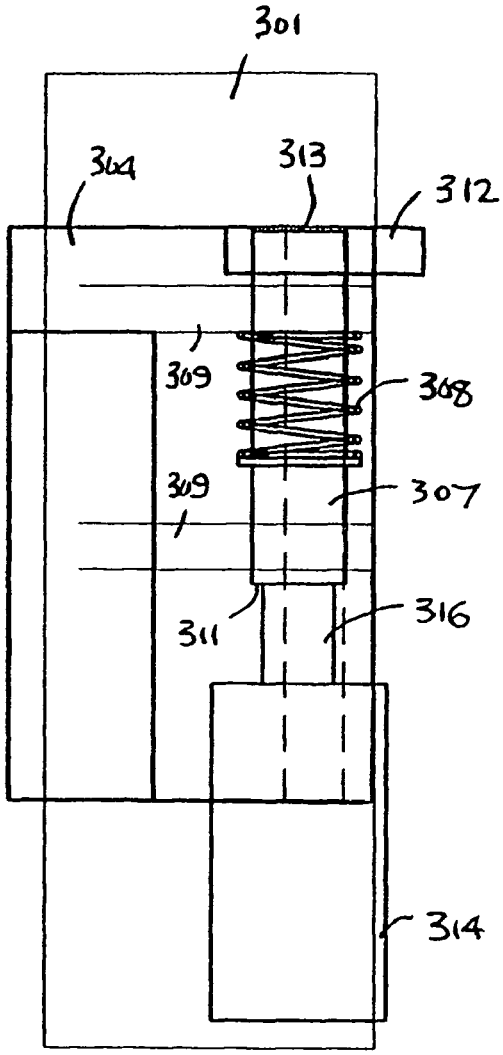
FIG. 17 is a schematic side elevation view of the latching strike assembly of FIG. 15 in a locked state.
Figure 18:
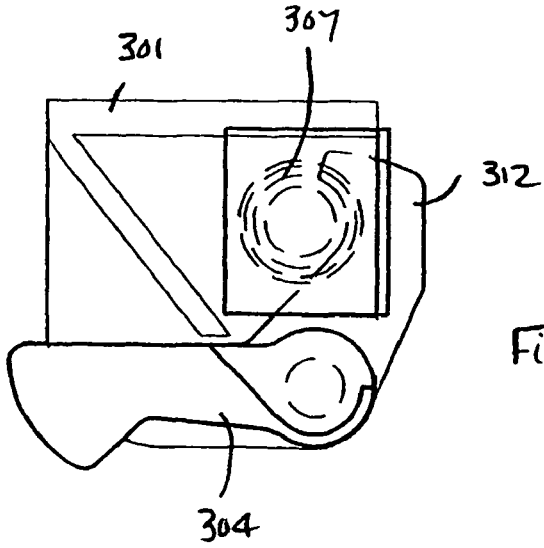
FIG. 18 is a schematic plan view of the latching strike assembly of FIG. 15 in a locked state.
Figure 19:
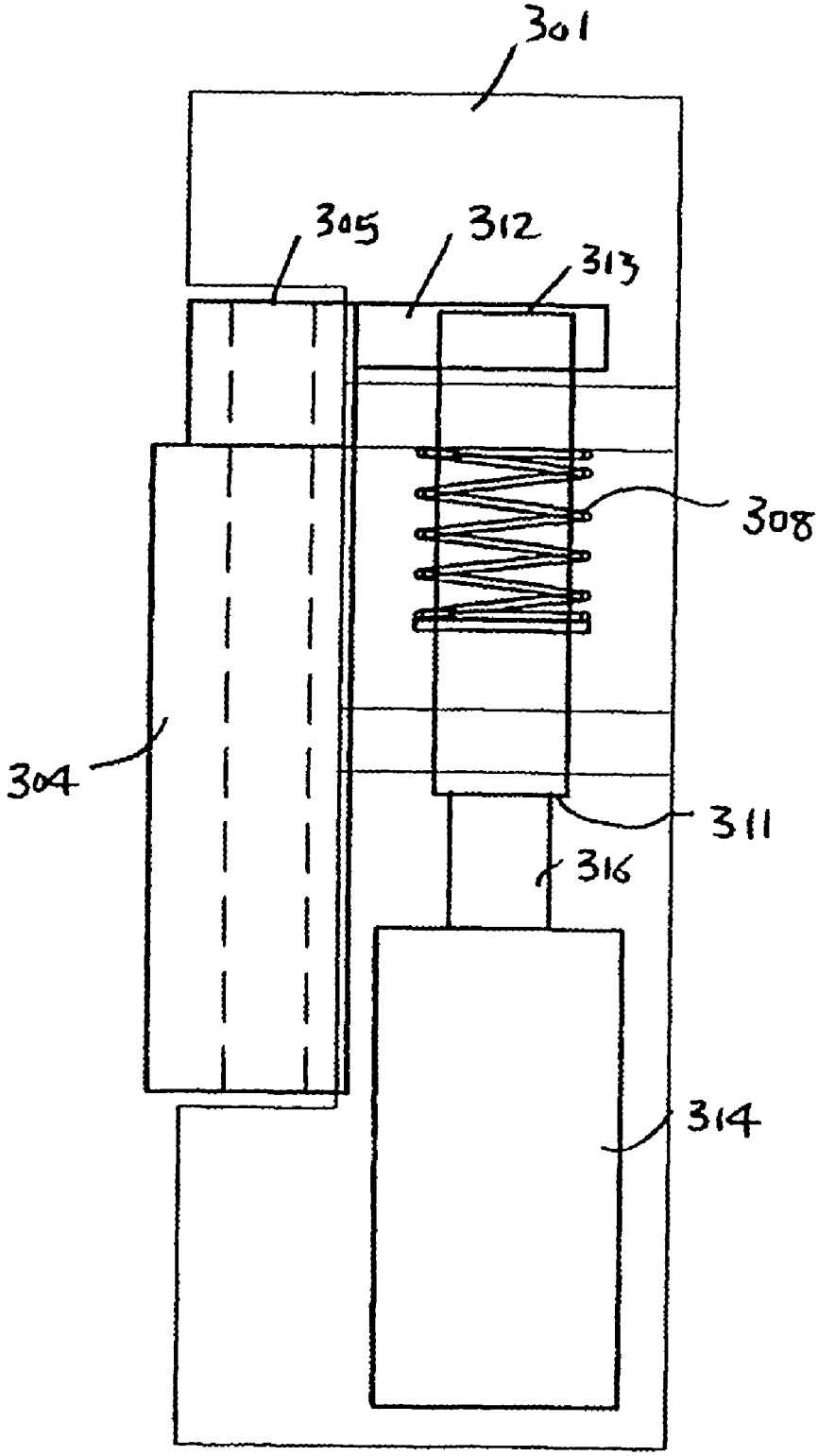
FIG. 19 is a schematic front elevation view of the latching strike assembly of FIG. 15 in a locked state.

The latching strike 304 is locked in the closed position, depicted in FIGS. 17 through 19, by way of a bi-stable detent in the form of a detent pin 307. In a similar manner to the detent pin 207 of the second latching strike assembly of FIGS. 8 to 14, the detent pin 307 is displaceable between a stable locking position, depicted in FIGS. 17 through 19, at which the detent pin 307 engages the latching strike 304 to lock the latching strike 304 in the closed position, and a stable unlocking position, depicted in FIGS. 20 and 21, at which the detent pin 307 is disengaged from the latching strike 304, thereby enabling the latching strike 304 to be deflected into the open position by the latching bolt 100.

The detent pin 307 is mounted within the assembly body 301 by two upstanding flanges 309 formed on the assembly body and each having an aperture through which the detent pin 307 extends, thereby enabling longitudinal displacement of the detent pin 307.

When the detent pin 307 is in the locking position, depicted in FIGS. 17 to 19, the peripheral surface of the detent pin 307 engages an arm 312 of the latching strike 304. As can be best seen from FIG. 18, engagement between the detent pin 307 and the latching strike arm 312 locks the latching strike 304 in the closed position, preventing it from rotating anti-clockwise (as viewed in FIG. 18) towards the open position.

Figure 20:
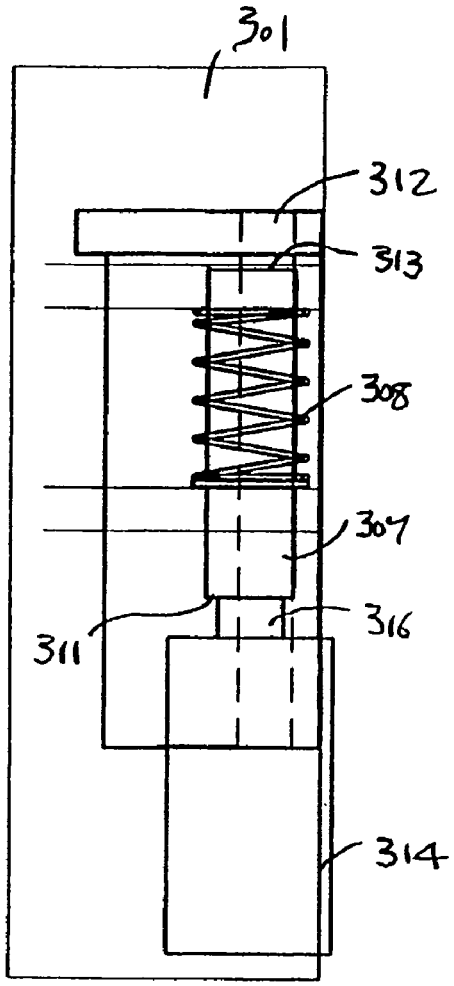
FIG. 20 is a schematic side elevation view of the latching strike assembly of FIG. 15 in an unlocked and open state.
Figure 21:
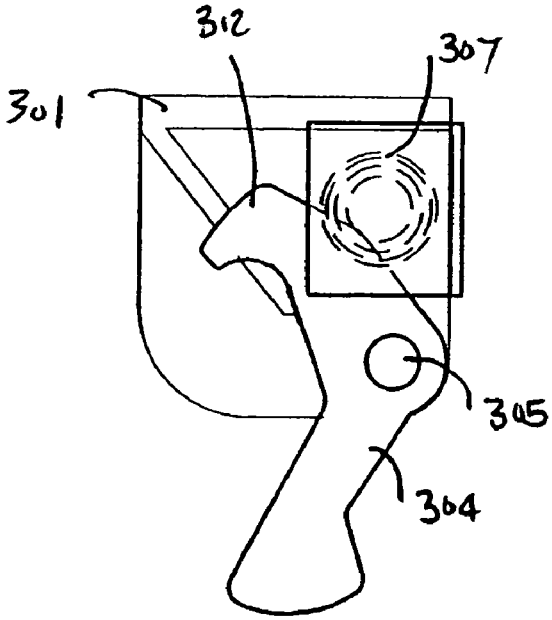
FIG. 21 is a schematic plan view of the latching strike assembly of FIG. 15 in an unlocked and open state.

When the detent pin 307 is displaced downwardly to the unlocking position depicted in FIGS. 20 and 21, the detent pin 307 disengages the latching strike arm 312, enabling the latching strike arm 312 to pivot past the upper end face 313 of the detent pin 207 as the latching strike 304 is moved to the open position (by engagement of the latch bolt 100 as the door is opened).

The detent pin 307 is displaced between the locking and unlocking positions by way of a signal solenoid 314. The solenoid 314 is a latching-type solenoid, being a solenoid having a plunger 316 displaceable from the retracted to the extended position when activated by a control signal of a first polarity. Upon reaching the extended position, a magnetic latching mechanism embodied within the solenoid magnetically latches the plunger 316 in the extended position. Upon re-activation of the solenoid with a control signal of a reverse polarity, the plunger 316 is moved toward the retracted position, overcoming the magnetic force latching the plunger 316.

In the configuration depicted, the latching solenoid 314 is configured such that a locking control signal activates the solenoid 314 to extend the plunger, engaging the detent pin lower end face 311 and driving it to the locking position. An unlocking control signal activates the solenoid to unlatch the plunger 316 and retract it. Once the retractive force acting on the plunger 316 overcomes the latching force, an internal return spring typically provided within the latching solenoid will continue driving the plunger 316 to the retracted position. If the detent pin lower end face 311 is fixed to the end face of the plunger 316, then retraction of the plunger 316 will displace the detent pin 307 to the unlocking position depicted in FIGS. 20 and 21. If, however, the detent pin lower face 311 is not fixed to the plunger 316, and/or if the internal return spring within the solenoid is of insufficient strength to fully retract the plunger 316 and detent pin 307, a return spring 308 may be mounted on the detent pin 307 to ensure the detent pin 307 is driven to the unlocking position when the solenoid plunger 316 is retracted. The solenoid latching mechanism and the return spring, whether mounted internally of the solenoid 314 or on the detent pin 307, provides bi-stability of the detent pin, ensuring that the detent pin 307 is stably held in either of the locking or unlocking positions.

The solenoid 314 may be arranged on the opposing end of the detent pin 307, such that extension of the solenoid plunger 316 drives the detent pin 307 to the unlocking position and retraction of the solenoid plunger 316 withdraws the detent pin 207 to the locking position.

As per the detents of the first and second latching strike assemblies described above, the detent 307 of the third latching strike assembly is moved between the locking and unlocking positions with only a single pulse activation of the solenoid 314. The third latching strike assembly of FIGS. 15 to 21 may accordingly be controlled in much the same manner as described for the first latching strike assembly of FIGS. 1 to 7.

The single solenoid arrangement of the third latching pin assembly provides a more compact latching strike assembly, particularly suited to installations where the body 301 is mounted on the exterior of the door jamb.

The invention claimed is:

1. A latching strike assembly for a door lock comprising:

a body adapted to be fitted to a door jamb, said body defining a recess for receipt of a latch bolt;

a latching strike mounted to said body and defining a boundary of said recess, said latching strike being pivotable between a closed position for retaining said latch bolt within said recess and an open position for releasing said latch bolt from said recess;

a bi-stable detent displaceable between a stable locking position at which said detent engages said latching strike to lock said latching strike in said closed position and a stable unlocking position at which said detent is disengaged from said latching strike, thereby enabling said latching strike to be deflected into said open position by said latch bolt; and a solenoid adapted to displace said detent from said locking position to said unlocking position when activated by an unlocking control signal of a first polarity and from said unlocking position to said locking position when activated by a locking control signal of a second polarity.

2. The latching strike assembly of claim 1 wherein said detent, when in said locking position, engages an arm of said latching strike to lock said latching strike in said closed position.

3. The latching strike assembly of claim 1 wherein said detent is linearly displaceable between said locking and unlocking positions.

4. The latching strike assembly of claim 3 wherein said detent comprises an elongate pin.

5. The latching strike assembly of claim 1 wherein said solenoid is a latching-type solenoid having a plunger displaceable between retracted and extended positions, displacement of said plunger to said extended position displacing said detent to one of said locking and unlocking positions, said solenoid having a latching mechanism for latching said plunger in said extended position, further wherein a return spring is operatively associated with at least on of said detent and said solenoid plunger to bias said plunger to said retracted position, and said detent to the other of said locked and unlocked positions, upon unlatching of said latching mechanism.

6. The latching strike assembly of claim 5 wherein said return spring is mounted on said detent.

7. The latching strike assembly of claim 5 wherein displacement of said plunger to said extended position displaces said detent to said locking position.

8. A latching strike assembly for a door lock comprising:

a body adapted to be fitted to a door jamb, said body defining a recess for receipt of a latch bolt;

a latching strike mounted to said body and defining a boundary of said recess, said latching strike being pivotable between a closed position for retaining said latch bolt within said recess and an open position for releasing said latch bolt from said recess;

a bi-stable detent displaceable between a stable locking position at which said detent engages said latching strike to lock said latching strike in said closed position and a stable unlocking position at which said detent is disengaged from said latching strike, thereby enabling said latching strike to be deflected into said open position by said latch bolt;

a return spring operatively associated with said detent to bias said detent to one of said locked and unlocked positions;

a magnetic latching mechanism operatively associated with said detent to retain said detent in the other of said locked and unlocked positions; and a solenoid adapted to displace said detent from said locking position to said unlocking position when activated by an unlocking control signal of a first polarity and from said unlocking position to said locking position when activated by a locking control signal of a second polarity.

* * * * *